United States Patent [19]

Schirneker

[11] 4,020,740

[45] May 3, 1977

[54] FIREARMS FOR SELECTIVELY CONTINUOUS AND NON-CONTINUOUS OPERATION

[76] Inventor: Hans-Ludwig Schirneker, Engelslit 10, 4773 Moehnesee-Voellinghausen, Germany

[22] Filed: Sept. 26, 1975

[21] Appl. No.: 617,178

[30] Foreign Application Priority Data

Sept. 26, 1974 Germany ..... 2445909

[52] U.S. Cl. ..... 89/129 B; 42/1 S; 42/50; 42/71 R; 89/1 K; 89/33 A; 89/33 MC; 89/191 A

[51] Int. Cl.[2] ..... F41D 11/10

[58] Field of Search ..... 89/1 K, 33 A, 33 MC, 89/129 R, 129 B, 191 R, 191 A, 198; 42/1 S, 50, 71 R

[56] References Cited

UNITED STATES PATENTS 2,948,194 8/1960 Godar ..... 89/129 B

*Primary Examiner*—Stephen C. Bentley

[57] ABSTRACT

A firearm adjustable into single-shot, burst and continuous operation modes is described. For operation in one of the non-continuous modes, an indexing device disposed on the rear portion of a first lever in the firearm trigger mechanism is placed into engagement with an advancing mechanism carried by a second lever that selectively actuates the firearm operating rod. The advancing mechanism has a second indexing device engageable with a plate or other transport device slidably mounted on the second lever and engageable with a catch on the operating rod. When the continuous mode is selected, the indexing device on the second lever rests in an idling recess disposed on the rear portion of the first lever forwardly of the indexing device thereon. An improved cartridge magazine and cartridge construction suitable for use in such firearm, together with improved facilities for operating the breech section of such firearm, are also described.

24 Claims, 23 Drawing Figures

5
5
2
3
7
11
11'
12
13
14
15
16
17
18
19
20
21
22
23
24
25
26
27
28
29
30
31
32
33
34
35
102
103
104
106
112

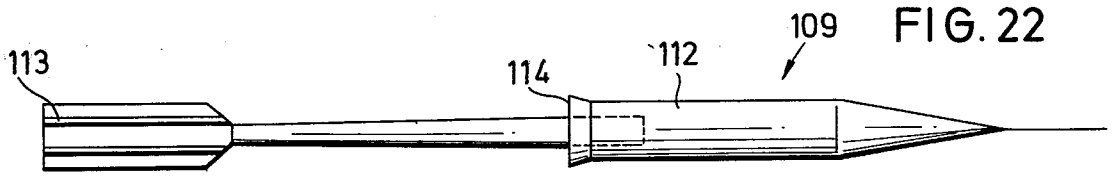
FIG. 22
FIG. 23
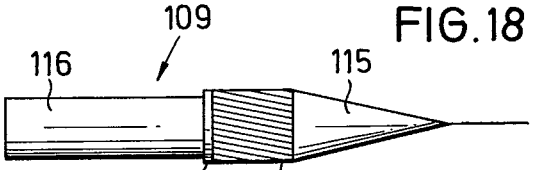
FIG. 18
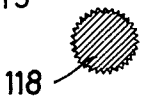
FIG. 19
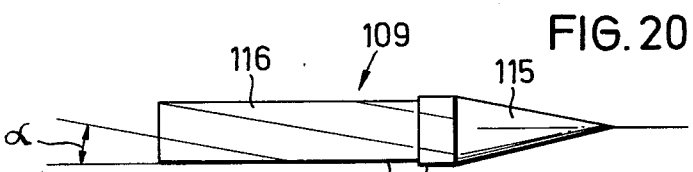
FIG. 20
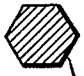
FIG. 21

FIREARMS FOR SELECTIVELY CONTINUOUS AND NON-CONTINUOUS OPERATION

BACKGROUND OF THE INVENTION

The invention relates to firearms, particularly shoulder arms and the like, which can be selectively operated in a continuous and a non-continuous manner.

Adjustable-mode firearms of this type are provided with a trigger mechanism including a hand-operated actuating lever, and an operating rod disposed above the trigger mechanism and longitudinally reciprocable between forward and rear positions. The operating rod has associated therewith a piston which reacts to the back gas pressure generated upon the firing of a cartridge forwardly through the barrel of the weapon to correspondingly move a cartridge chamber, which is coupled to the rear portion of the operating rod, from a closed-breech to an open-breech position to discharge the spent cartridge shell. Upon the next forward movement of the rod and the cartridge chamber, such chamber is again moved into a closed-breech position in which a new shell is guided into the chamber from a magnitude disposed in the stock of the weapon. When the firearm is adjusted for continuous operation, such reciprocation of the operating rod and the associated components continues so long as the actuating lever in the trigger mechanism is held back and a firing pin associated with the rear of the cartridge chamber remains in an uncocked position. In the non-continuous mode, the operating rod comes to rest after each two-way reciprocation behind a projection disposed on a spring-loaded rocker arm which is withdrawable against the force of its spring each time the trigger is pulled.

Presently known firearm designs of this type are relatively expensive and heavy, and are difficult to service and maintain. The changeover in the trigger mechanism from continuous to non-continuous operation, and vice-versa, is relatively complicated as well.

SUMMARY OF THE INVENTION

Such disadvantages are overcome by the improved firearm construction in accordance with the invention, wherein the weapon is simply and effectively adapted for the rapid selection of the operating mode of the weapon. Such operating modes may include non-continuous operation (i.e., single-shot or burst), or continuous operation.

Illustratively, the trigger mechanism of the improved firearm includes a first lever that is movable into at least first and second positions indicative of the non-continuous and continuous operations of the weapon. An indexing arrangement, i.e., a pawl or a plurality of pawl-receiving recesses, are disposed on a rear portion of a first lever engageable by the finger-operated actuating lever. A second lever, which may be embodied as a spring-loaded rocker arm, is engageable with the rear portion of the first lever when the actuating lever is pulled back, and includes a projection which is withdrawably positionable in the path of a corresponding projection on the operating rod for restraining such rod until the actuating lever is pulled.

Such second lever carries an advancing or indexing mechanism engageable with the indexing mechanism on the rear portion of the first lever, and an additional indexing mechanism which cooperates with similar indexing means on a slide or other transport device which is movably mounted on the second lever. Such transport device is actuable to index the advancing mechanism carried by the second lever each time the operating rod reciprocates.

When the first lever is adjusted into the first position indicative of a single-shot or burst mode, the indexing arrangement on the rear end of the first lever engages with the corresponding part on the advancing mechanism, whereby the firearm discharges, while the actuating lever is held back, during the interval when the first lever is indexed by the advancing mechanism. (For single-shot operation, only the rearmost indexing notch on the first lever is contacted by the advancing mechanism.)

When the first lever is selected for continuous operation, the advancing mechanism is out of engagement with the indexing notches on the first lever, and may rest in an idling notch disposed forwardly of the indexing notches on the first lever.

A feature of the invention is a retarding means adapted to slow the repetition rate of the weapon when in its continuous-operation mode, to allow the gas pressure generated after each discharge operation to build up to a point sufficient to assure efficient ejection of the spent cartridge shell from the cartridge chamber. For this purpose, the front end of the first lever in the trigger mechanism is provided with an inclined surface that cooperates with a wedge selectively urged against a projection on the front end of an operating rod. Such wedge is attached to a cylinder-piston type of damping mechanism, and such wedge is moved free of the projection on the operating rod by the camming action of the inclined surface on the first lever whenever such lever is adjusted into its single-shot or burst position. Alternatively, such repetition rate-slowing mechanism may include an inclined surface on the rear portion of the operating rod, such rod being engageable with a piston-driven wedge in the trigger mechanism during the return movement of the operating rod.

Another feature of the invention is an improved arrangement for operating the firing pin that is adapted to impact the percussion cap of the successive cartridges introduced into the cartridge chamber. The opposite ends of the firing pin may advantageously be respectively connected to a tension spring affixed to the firing chamber and to a fixed-position operating lever that is movable in synchronism with the movement of the operating rod and thereby the cartridge. If desired, the firing pin may be connected to one end of an operating rod whose opposite end is eccentrically mounted on a disc which is driven by a piston that moves in synchronism with the reciprocation of the operating rod. Advantageously, the cartridge chamber itself is mounted for oscillation in synchronism with the rotation of the disc, and for this purpose a second operating rod extends from a point on the circumference of the cartridge chamber to a point on the operating disc. Alternatively, a toggle lever may be employed to effect the oscillation.

BRIEF DESCRIPTION OF THE DRAWING

Further characteristics and advantages of the firearm constructed in accordance with the invention are set forth in the following detailed description taken in conjunction with the appended drawing, in which:

FIG. 18 is a longitudinal view of an improved form of projectile suitable for use in the cartridge of FIG. 17;

FIG. 19 is a cross-sectional view of a portion of the projectile of FIG. 18;

FIG. 20 is a longitudinal view of another embodiment of projectile suitable for use in the cartridge of FIG. 17;

FIG. 21 is a cross-sectional view of a portion of the projectile of FIG. 20;

FIG. 22 is a longitudinal view of another embodiment of projectile suitable for use in the cartridge of FIG. 17; and FIG. 23 is a cross-sectional view of a portion of the projectile of FIG. 22.

DETAILED DESCRIPTION

Figure 1:
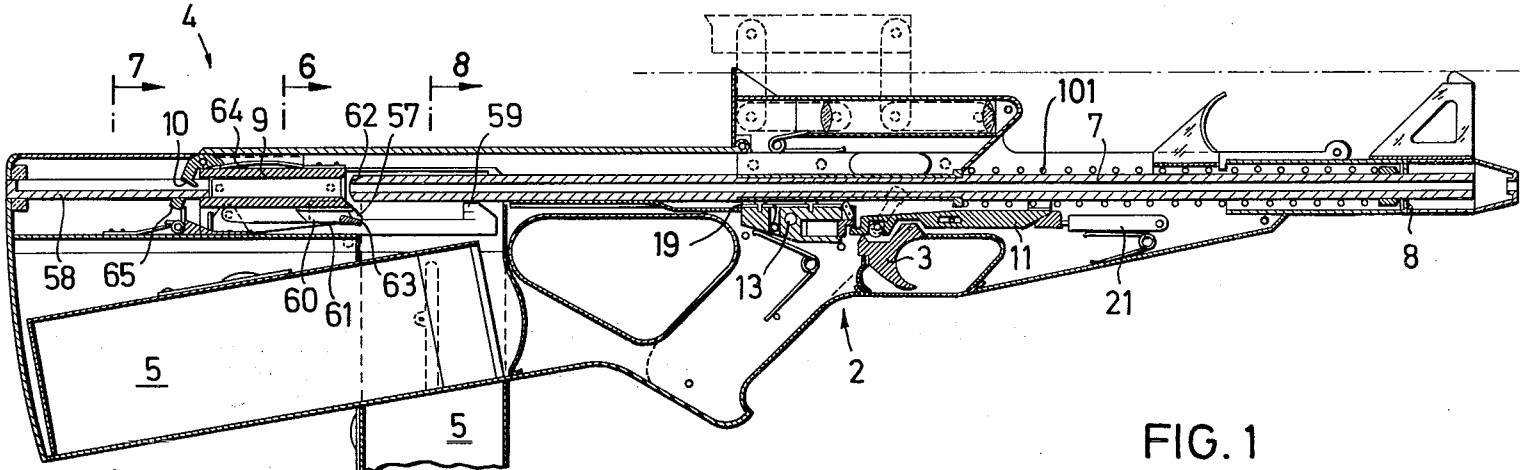
FIG. 1 is a longitudinal view, partially in section, of a firearm constructed in accordance with the invention.

Referring now to the drawing, FIG. 1 depicts an improved firearm 100 having facilities for operation in a single-shot, burst or continuous mode. In general, the firearm 100, which may be a gas-operated shoulder arm, includes an elongated barrel 7 whose rear end is alignable with a cylindrical cartridge chamber 9. The barrel 7 is associated with an operating rod 6, which at its front end is coupled to a piston 8 that is supported with respect to the barrel 7 by means of a spring 101. The operating rod 6 is suitably coupled to the cartridge chamber 9, which is disposed in a breech section 4 of the firearm 100. A trigger mechanism 2 is disposed below the barrel 7 and the operating rod 6, and includes a conventional trigger or actuating lever 3. When such trigger 3 is pulled back, the operating rod 6, which is initially held back in a rear position against the force of the spring 101 is released and is propelled forward in such a way that a firing pin 10 disposed at the rear of the cartridge chamber 9 strikes the percussion cap (not shown) of a cartridge introduced into the chamber 9 from a magazine 5, whereupon the bullet in the cartridge is discharged through the front end of the barrel 7.

Upon the discharge of the projectile, the force of the gases emerging from the front end of the barrel 7 propels the operating rod rearwardly again against the force of the spring 101. Since the chamber 9 is coupled to the moving rod 6, the cartridge chamber will move against an expulsion rod 58 disposed behind the chamber, and the spent cartridge case will be suitably ejected, and a fresh cartridge will be introduced into the chamber 9 from the magazine 5.

When the rifle 100 is operative in its continuous-firing mode as indicated below, such reciprocation of the operating rod 6 and the associated operations will occur for so long as the trigger 3 is maintained in its pressed-back position. On the other hand, when the firearm is set for one of its non-continuous modes (i.e., single-shot or burst), the reciprocating action of the rod 6 will be maintained for one or a prescribed plurality of shots.

Figures 3, 4:
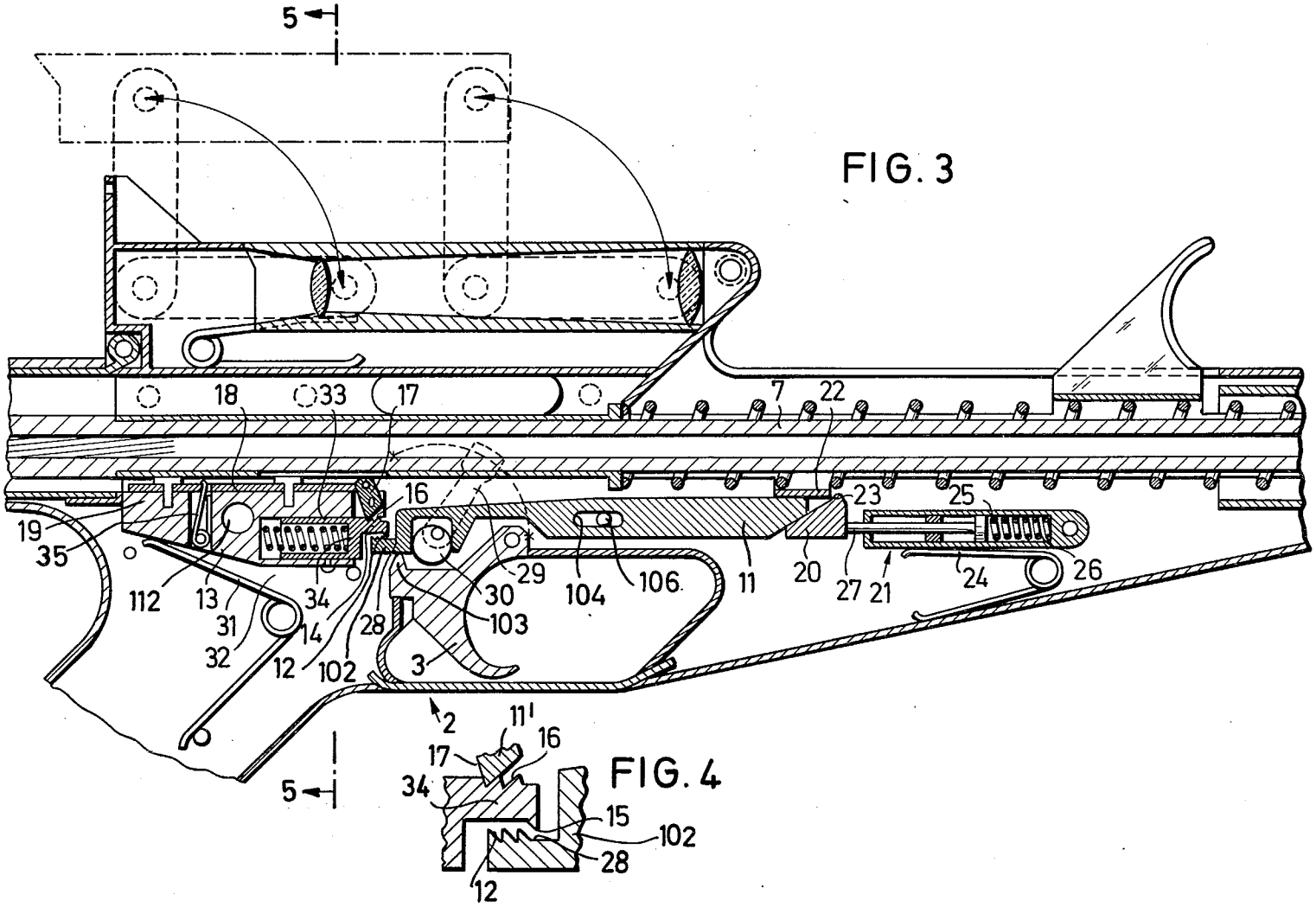
FIG. 3 is an enlarged view in section of a portion of the firearm of FIG. 1.
FIG. 4 is an enlarged fragmentary view, in section, of mating index arrangements on the ends of cooperating levers in the trigger mechanism of the arrangement of FIG. 3.
Figure 5:
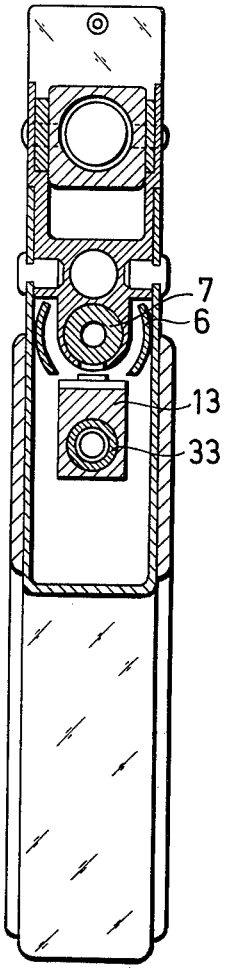
FIG. 5 is a sectional view taken along line 5—5 of FIG. 3.
Figure 12:
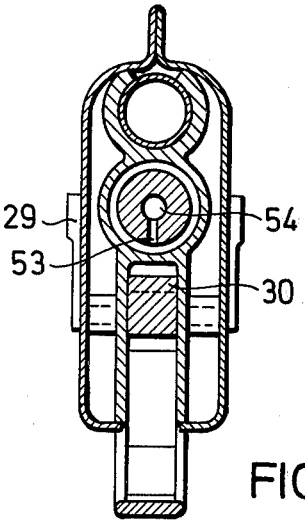
FIG. 12 is a sectional view taken along line 12—12 of FIG. 11.

In accordance with the invention, an improved form of the trigger assembly 2 for optimum operation of the firearm 100 in either of its operating modes is illustrated. As shown best in FIG. 3, for example, a first elongated lever 11 has a rear portion 102 engageable with a projection 103 on the trigger actuating lever 3. Such lever 11 is provided with an elongated, longitudinally extending slot 104 which cooperates with a pin 106 so that the lever 11 may be adjusted between a continuous-operation position (i.e., when the lever 11 is in its left-most position with respect to the pin 106), a single-shot position (i.e., when the lever 11 is in its right most position as shown in FIG. 3), and in an intermediate burst or intermittent position, whereby a predetermined number of successive shots may be fired. The lever 11 cooperates with a spring-loaded rocker arm 13, which carries therein an indexing or advancing member 14. In the embodiment shown, the advancing member 14 includes a cylinder-piston set 32 carried longitudinally in the rocker arm 13, such set 32 exhibiting a spring-loaded piston 33. The piston 33 is affixed to a piston rod 34, which at its outer end includes a downwardly extending pawl 15 cooperable with a plurality of indexing notches 12, 12 on the end 102 of the lever 11. The piston rod 34 also includes, on a surface of its outer end opposite that of the pawl 15, a plurality of indexing notches 16, 16 which are cooperable with a pawl 111 disposed on a transport member 17, illustratively a lever.

The transport member 17 is actuable to urge the piston rod 34 rearwardly against the force of its associated spring when such member 17 is contacted by a plate 18, which is slidably mounted on the rocker arm 13. The plate 18 is biased in a rearward direction by means of a spring 35. The arm 13 is normally contacted by an abutment surface 19 of the operating rod 6, thereby preventing actuation and forward movement of the rod 16 when the trigger 3 is in the cocked position shown in FIG. 3.

The operation of the trigger mechanism 2 when it is desired to operate the firearm 100 in its continuous-firing mode is as follows. Initially, the lever 11 is moved longitudinally into its left-most position as viewed in FIG. 1 by means of a switching member 29 which is coupled to the lever 11 via an eccentric 30. In this position, the pawl 15 of the piston rod 34 carried by the rocker arm 13 is disposed directly above an idling recess 28 on the rear end 102 of the lever 11. Such idling recess 28 is disposed forwardly of the indexing notches 12.

With the lever 11 in this position, the pulling of the trigger 3 will cause its upper projection 103 to engage the rear portion 102 of the lever 11 and will bring the idling recess 28 into engagement with the pawl 15. Such upward force on the right end of the rocker arm 13 will cause the top surface of the rocker arm 13 to rotate counterclockwise out of the path of the abutment surface 19 of the operating rod 6 so that the rod 6 can be propelled forwardly in association with the discharge of the shell then in the cartridge chamber.

During the forward movement of the operating rod 6, the rod contacts the back of the sliding plate 18, which pivots the transport lever 17, which because of the engagement of its pawl 111 (FIG. 4) with the notches 16 on the piston rod 34, will attempt to push the rod 34 rearwardly. However, since the associated pawl 15 is disposed within the idling recess 28, such pushing force of the pawl 111 will be insufficient to move the piston rod 34, so that when the operating rod 6 returns for its next cycle, provided the trigger 3 is still pushed back, the rocker arm 13 will remain in its withdrawn position against its associated spring 31, and the rod 16 will be free to commence a new forward motion. Such reciprocation of the rod 6, and the accompanying firing of the cartridges, will continue so long as the trigger 3 remains pushed and ammunition remains in the firearm.

If, on the other hand, a single-shot mode is desired, the switching arm 29 is adjusted until the lever 11 is in its right-most position, i.e., with the left-most indexing notch 12 in vertical alignment with the pawl 15 of the piston rod 34. In this case, when the trigger 3 is pulled, the rocker arm 31, being acted upon by the upward pressure of the lever end 102 on the piston rod 34, will again move the restraining surface of the rocker arm 31 away from the abutment surface 19 on the rod 6, so that the rod will move forwardly and push the plate 18 against the transport lever 17 as before. The resulting rearward force applied by the pawl 111 of the lever 17 to the notches 16 on the piston rod 34 against the force of the associated spring will be effective to move the rod 34 to the left, since the restoring force of the spring is resisted by the presence of the pawl 15 in the recess 12. Since the pawl 15 is on the same structure as the notch 16, however, such rearward movement will effectively index the piston rod 34 away from the lever 11, so that the rocker arm 13 is now free to pivot back via the force of its spring 31 into a position in the path of the abutment surface 19 on the operating rod 6. Consequently, after the completion of the single return movement of the rod 6, an attempt of the rod to again move forwardly will be restrained by the presence of the top surface of the rocker arm 13, and the firearm 101 will not be discharged, notwithstanding a continued pull on the trigger actuating lever 3.

Whenever it is desired to operate the firearm in a burst mode, whereby illustratively two shots are to be fired while the trigger is continually depressed, the lever 11 is positioned via the switching arm 29 into an intermediate position with the second indexing notch 12 from the left, as viewed in FIG. 4, in alignment with the pawl 15 on the piston rod 34. As a result, when the trigger 3 is pulled, the first reciprocation of the rod 6 will proceed exactly as in the single-shot mode described above, with the piston rod 34 being indexed to the left by the rearward force applied thereto via the pawl 111. Such indexing movement, however, will not bring the piston rod 34 clear of the lever 11, but instead will bring the left-most notch 12 of such lever 11 into alignment with the pawl 15. Consequently, one additional reciprocation of the operating rod 6 can take place before the piston rod 34 completely clears the lever 12, after which the rocker arm 31 is free to pivot back into its normal position in the path of the operating rod 6. It will be appreciated that any desired number of successive shots can be accomplished in such burst mode, such number of shots corresponding to the number of indexing notches 12 between the initially set position of the lever 11 and the left edge of the lever portion 102 illustrated in FIG. 4.

Since the reverse movement of the operating rod 6 is initiated by the gas pressure built up during firing, and since the extraction of the spent cartridge from the cartridge chamber is effected by means of such return rod movement and thereby the gas pressure, a feature of the invention is the selective retardation of the movement of the operating rod during the continuous-fire mode so that the discharge phase of the cartridge chamber is delayed until a sufficient gas pressure has been built up. For this purpose, the operating rod is provided with a projection surface 22 on a forward portion of its length, such projection 22 being engageable by a surface 23 of a wedge 20 which is normally urged, via a spring 24 and a cylinder-piston set 21, upwardly and rearwardly against the projection 22. The wedge 20 is carried on a piston rod 27 associated with the piston 25 of the set 21, such piston being restrained for movement in the forward direction by means of a spring 26 or other suitable damping arrangement.

Since such retardation feature is not needed for the non-continuous modes of the firearm 100, a front surface 112 of the lever 11 is inclined to cooperate with the surface 23 on the wedge to move such wedge away from the projection 22 against the force of the spring 24 and the damping set 21 so that the movement of the operating rod 6 can proceed unimpeded. As indicated above, such non-continuous operation is selected when the switching arm 29 moves the lever 11 to a right-hand position as viewed in FIG. 3.

Referring again to FIG. 1, the firearm 100 is provided, at the rear of the breech portion 4, with the pushrod 58 which is cooperable with the bore of the cartridge chamber 9 for ejecting a spent cartridge therefrom when the operating rod, and thereby the chamber 9, is moved to the rear following each shot. In order to introduce shells into the cartridge chamber 9 from the magazine 5 which is located forwardly of such chamber, the chamber may be provided with a wedge 63 and with a follower member 59 associated with a clamping member 60 having a loading spring 61. The follower 59 is coupled to the cartridge chamber 9 and extendable toward the magazine 5 for aligning the top shell in the magazine with the bore of the chamber 9, and the spring-loaded clamping means 60, 61 is adapted to forcibly urge the so-aligned top shell into the chamber. In order to help eject the spent cartridges from the chamber 9, the pushrod 58 cooperates with a wedge 57 and with an inclined surface 62 as shown. The wedge 57 engages the spent cartridge casing during the return movement of the cartridge chamber 9, and the resulting upward movement of the spent casing is discharged via the surface 62.

Figure 7:
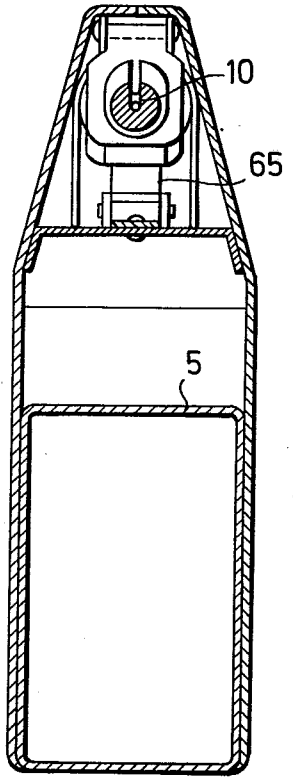
FIG. 7 is a view taken along line 7—7 of FIG. 1, illustrating the firing pin and support arrangement for the arrangement of FIG. 1.

A firing pin 10 (FIGS. 1 and 7) is associated with the rear of the cartridge chamber for selectively impacting and detonating a percussion cap (not shown) of a fresh cartridge inserted into the chamber 9. One end of such pin 10 is coupled to a tension spring 64 affixed to the chamber 9, and the other end of the pin 10 is engageable against a spring-loaded abutment 65, which is movable out of the way of the pin 10 as the cartridge chamber moves forward and which is straightenable into the position shown upon the next reverse movement of the chamber 9.

Figure 8:
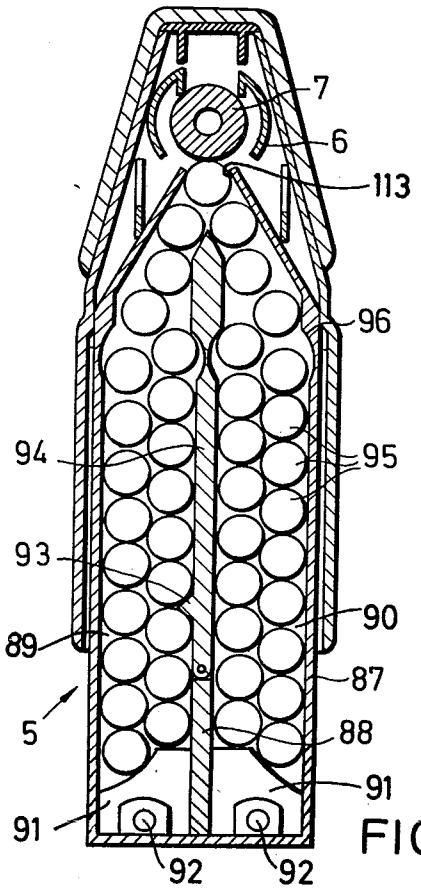
FIG. 8 is a view taken along line 8—8 of FIG. 1, illustrating certain details of an improved magazine for introducing cartridges into the cartridge chamber of FIG. 1.
Figure 6:
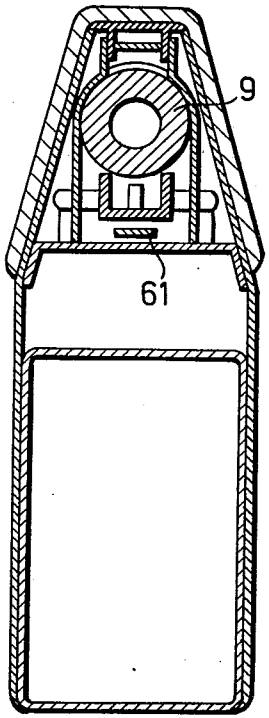
FIG. 6 is a sectional view taken along line 6—6 of FIG. 1, illustrating certain details of the cartridge chamber and associated components in the arrangement of FIG. 1.

An advantageous construction of the magazine 5 is shown best in FIG. 8. The magazine includes a loading chamber 87 divided into two compartments 89 and 90 by means of a separation wall 88. A plurality of shells 95, 95 are arranged in two vertical staggered rows in each of the compartments 89 and 90 as shown, the shells in the rows being urged upwardly via a pair of pushing members 91, 91 under the force of a pair of springs 92, 92 mounted outside the compartments 89, 90.

The separating wall 88 includes an outward projection 93 extending into the compartment 89, such projection 93 being associated with a hinged portion 94 of the wall 88.

Illustratively, the compartment 90 is first emptied of shells seriatim, and then the hinged section 94 with its blocking projection 93 is pivoted toward the now-empty compartment 90 to permit the shells in the other compartment 89 to be discharged. Such discharge is facilitated by means of pairs of opposed recesses 96, 96 disposed in the upper portions thereof, and are discharged via an output aperture 113 in the manner described, e.g., in the copending, coassigned application Ser. No. 567,834 filed Apr. 14, 1975. The successive discharged shells are picked up by the follower member 59 (FIG. 1) for guidance into the cartridge chamber 9, as indicated above.

Figure 2:
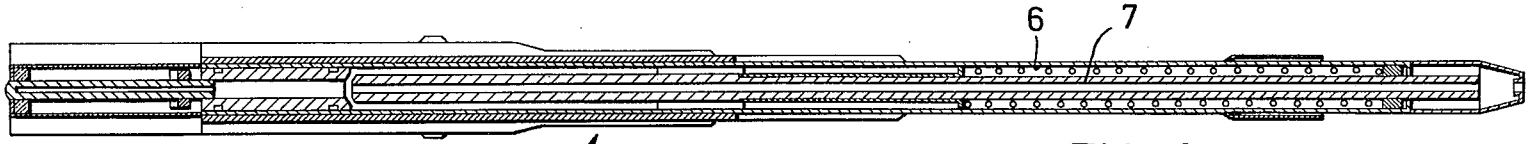
FIG. 2 is a longitudinal section through the operating rod and barrel of the arrangement of FIG. 1.
Figures 9, 10, 11:
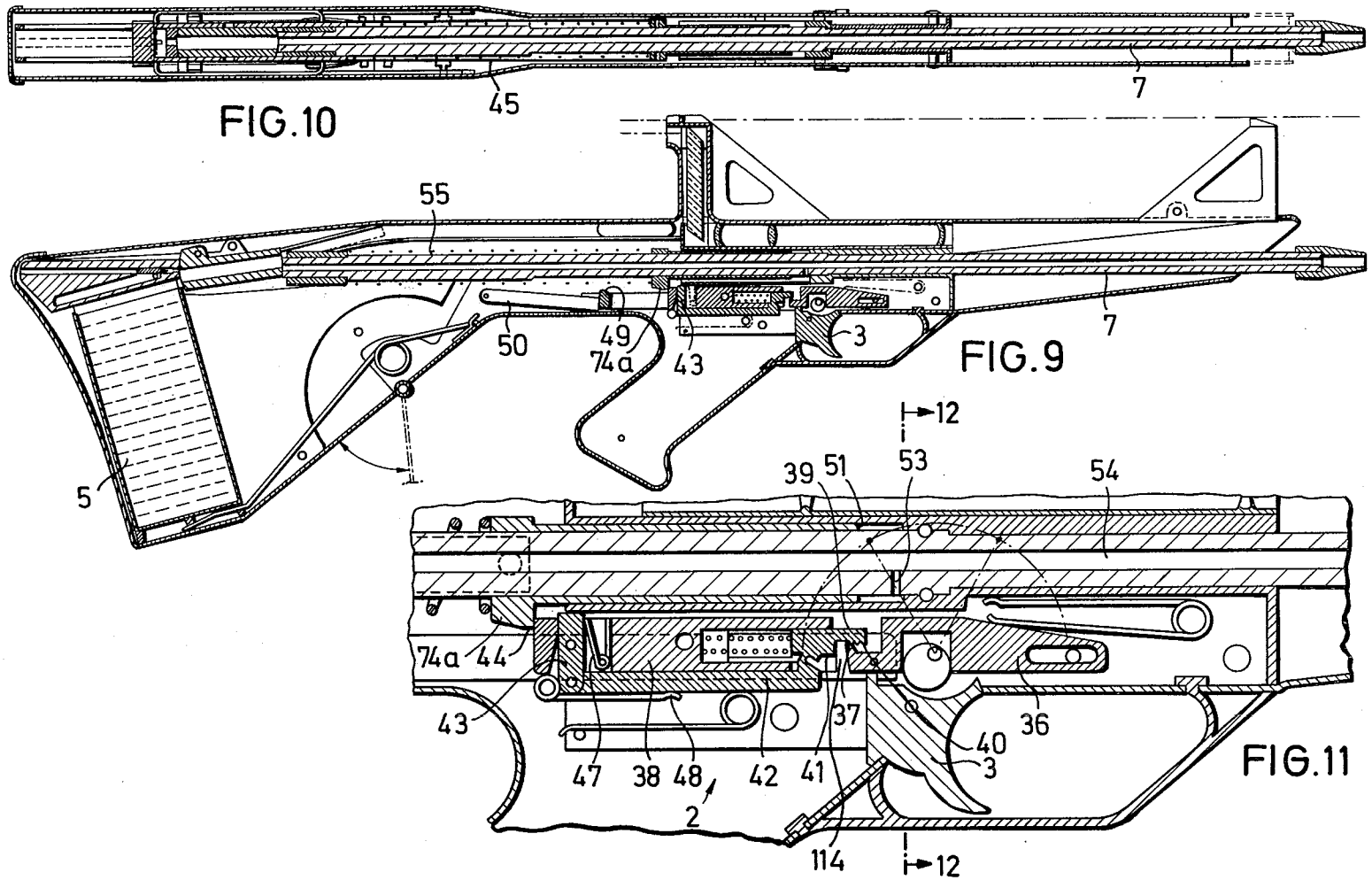
FIG. 9 is a longitudinal view in section of a second embodiment of the firearm in accordance with the invention.
FIG. 10 is a longitudinal view in section of the operating rod and barrel assembly of FIG. 9.
FIG. 11 is an enlarged view in section of a portion of the arrangement of FIG. 9.

The arrangement of FIGS. 9–11 illustrates a modification of the firearm 100 of FIGS. 1–3. In FIG. 11, there is indicated a hollow piston 51 coupled to an operating rod 45 and spring-loaded via a spring 55. The piston 51 is disposed much further back on the barrel than the piston 8 of FIG. 1, and is loaded by means of a spring 55. The piston 51, which may be affixed to the front end of an operating rod 45, may be disposed over the trigger assembly, thereby considerably shortening the required length of the rod 45. Advantageously, a gas-permeable radial opening 53 is disposed in the wall of a barrel 54, so that gases generated in such barrel as a result of each shot can be applied to the front end of the piston 51 to initiate the reverse movement of the operating rod 45 against the spring 55.

The trigger mechanism 2 illustrated in the second embodiment is similar in principle to that of the arrangement of FIGS. 1–3, and includes a lever 36 which is positionable into continuous and non-continuous firing positions in a manner similar to that of the lever 11 of FIG. 1. The rear end of the lever 36 is engageable by an upward projection on the trigger actuating lever 3. The lever 36 cooperates with a spring-loaded advancing member 39 carried on a rocker arm 38, which is analogous to the rocker arm 13 of FIG. 3. A lever 43 is supported for oscillation on the rocker arm 38, and is engageable with an abutment surface 44 on the operating rod 45 for restraining the rod 45 from forward movement until the actuating lever 3 is pulled. The lever 43 is adapted, when the operating rod moves forward, to impart a forward movement to a transport pusher 42, which is normally urged in a rearward position by means of a spring 47. The rocker arm 38 is normally urged toward the operating rod 45 by means of a spring 48.

Advancing mechanism 39, spring-loaded within the rocker arm 38, includes indexing notches engageable with a cooperating pawl on the transport pusher 42, and further includes indexing notches 40 which are cooperable with a pawl 37 on the end of the lever 36 when the lever 36 is adjusted into its right-most position indicative of non-continuous operation. The member 39 further has an idling recess 114 disposed behind the indexing notches 40, such recess 114 being engageable with the pawl 37 when the lever 36 is selected for continuous operation. It will be appreciated that the operation of the trigger mechanism 2 of FIG. 11 proceeds in a manner similar to that of the corresponding mechanism of FIG. 3.

In order to retard the motion of the operating rod 45 in FIG. 9 for the purposes discussed above, the rod 45 is provided with an inclined surface **74*a* which is cooperable with a wedge 49 coupled to a damping arrangement 50. Thus, in the continuous-operation mode, the wedge 49, which may be suitably spring-loaded for biasing in an upward direction, engages the surface 74*a* on the operating rod 45 during the return movement thereof to inhibit the full return of the rod until the gas pressure in the barrel 54 has increased to a value sufficient to effect an efficient ejection of a spent cartridge from the chamber 9. The structure and operation of the damping arrangement 49, 50 may be similar to that of the arrangement 20, 21 of FIG. 3**.

Figure 14:
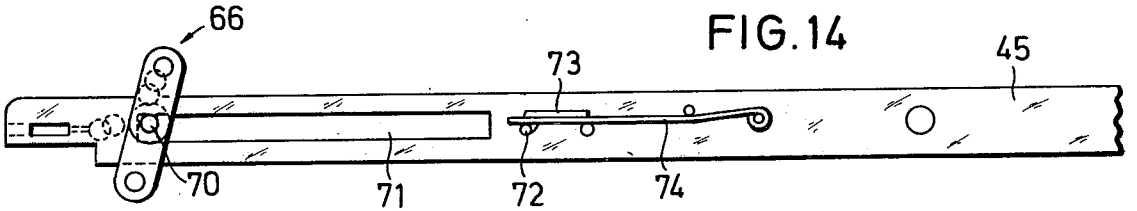
FIG. 14 is a view illustrating the manner in which the cartridge chamber of FIG. 13 is supportable for oscillation with respect to the barrel.
Figure 13:
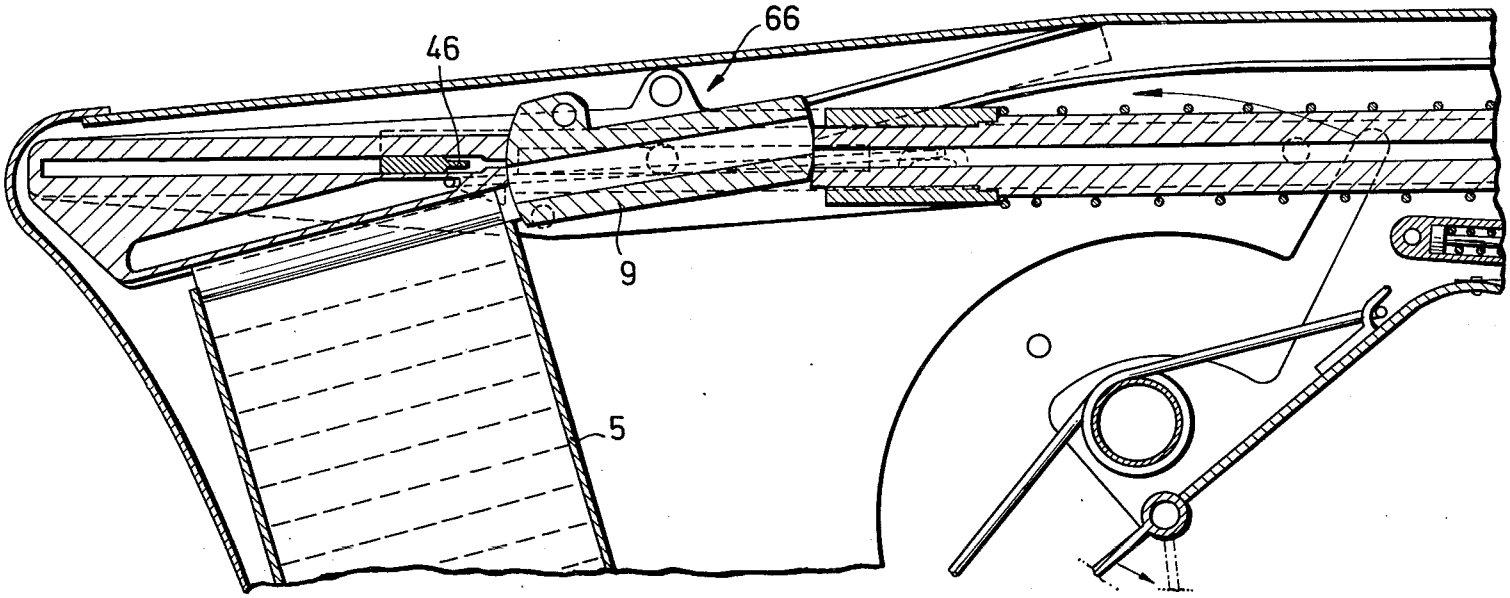
FIG. 13 is an enlarged view in section of another portion of the arrangement of FIG. 9.

As shown best in FIGS. 13–14, the firearm of FIG. 9 may be provided with facilities for oscillating the cartridge chamber 9 into a predetermined number of fixed positions depending on the degree and direction of movement of the operating rod 45. Such oscillation may be imparted by means of a suitable toggle lever arrangement 66, which is suitably coupled to the operating rod 45 for movement into (1) a position parallel to the barrel axis when the operating rod is cocked prior to actuation of the trigger 3, (2) a swung-out position effective when the operating rod 45 moves rearwardly, and (3) a partially swung-out position effective when the rod 45 moves partially forward, such blocking position being such as to prevent both loading and discharge of the firearm.

Figure 15:
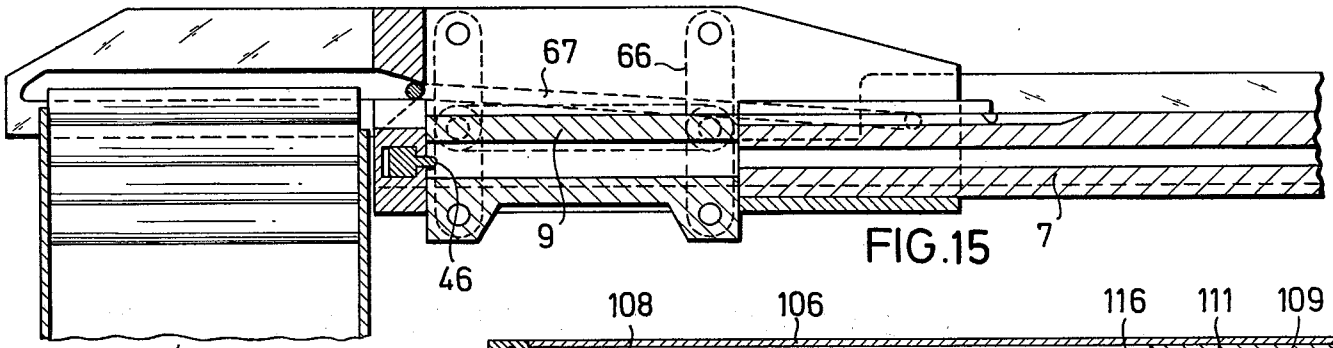
FIG. 15 is an enlarged view illustrating an alternative means of supporting the cartridge chamber of FIG. 13 for oscillation.

A single lever 66 may be employed for such purpose, as shown in FIG. 14, or if desired a pair of such levers may be used, as depicted best in FIG. 15. In the arrangement of FIG. 14, a projection 70 on the lever 66 extends into a longitudinal guiding recess 71 on the rod 45, whereby the reciprocation of the rod effects the desired movement of the lever 66 into the three discrete positions indicative of the desired orientations of the cartridge chamber 9. The arrangement of FIG. 14 further includes a spring-loaded insertion pin 72 which extends into an adjustable groove 73 in the rod 45, such pin 72 being biased by means of a spring 74.

Figure 16:
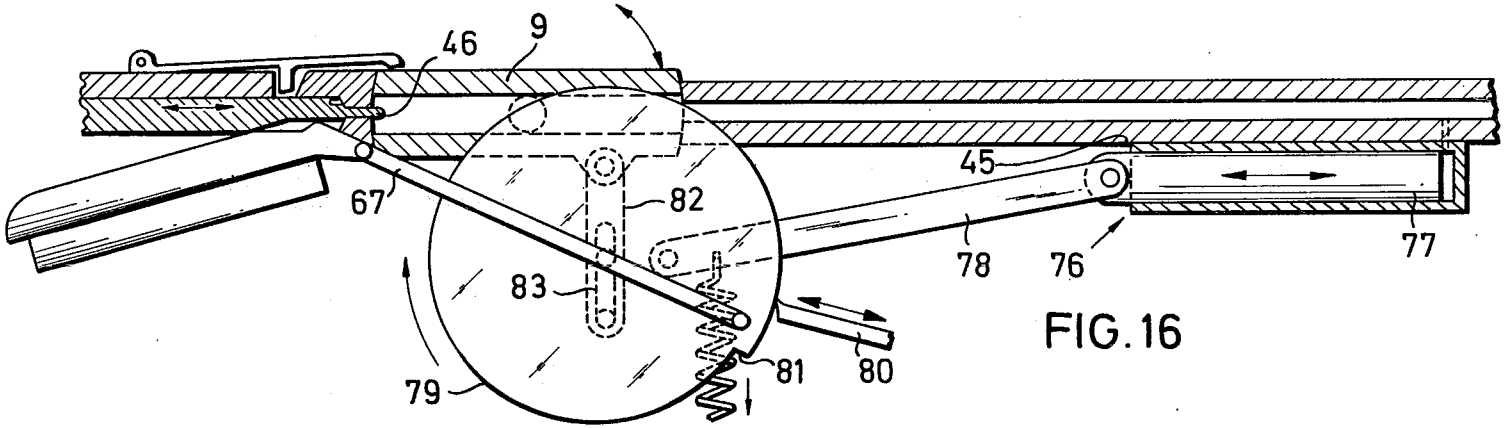
FIG. 16 is an enlarged view of still another arrangement for supporting the cartridge chamber of FIG. 13 for oscillation.

FIG. 16 illustrates a technique for synchronizing the oscillating movement of the cartridge chamber 9 with the movement of a follower 67 analogous to the member 57 of FIG. 1 for guiding the topmost shell in the magazine into the cartridge chamber. In particularly, a cylinder-piston set 76 has a piston 77 which is reciprocable with the rod 45. The piston 77 is coupled to a connecting rod 78, which rotates a drive disc 79 in synchronism with the reciprocation of the piston 77. The handle of the follower 67 is eccentrically mounted on the disc 79, and a lever 82 coupled to the cartridge chamber 9 has a longitudinal slot 83 carried by a central pin of the disc 79. Also, a firing pin 46 associated with the rear of the chamber 9 is carried by an intermediate point of the follower 67. Thus, the rotation of the disc 79 caused by the reciprocation of the piston 77 and the operating rod 45 is effective to oscillate the chamber 9, move the firing pin 46, and position the follower 67 in a desired sequence. A ratchet-type rotational sequence may be imparted to the disc 79 by associating a pawl 80 with an abutment surface 81 on the periphery of the disc 79.

Figure 17:
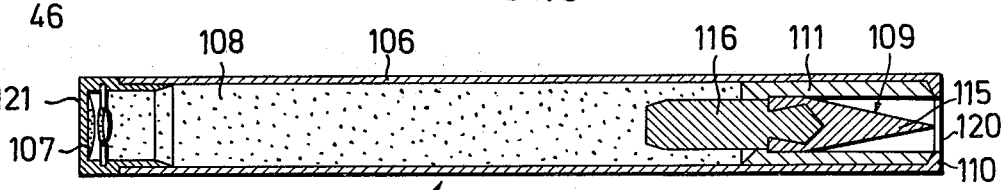
FIG. 17 is a longitudinal view in section of an improved cartridge suitable for use in the firearm of FIGS. 1–16.

An improved type of shell cartridge suitable for use in the firearm arrangement thus far described is illustrated in FIG. 17. The cartridge, designated 95, includes a cylindrical shell casing 106, a socket or bushing member 111 supported on a forward portion of the casing 106, and a projectile 109 supported entirely within the casing 106 with its outer surface contacting the bushing 111. A front end 110 of the casing 106 may exhibit a radially inward bend as shown for the purposes set forth in the above-mentioned copending application Ser. No. 567,834.

The rear end of the shell 95 includes a percussion cap 107. A propelling charge 108, illustratively in the form of a briquette which conforms to the inner cylindrical surface of the casing 106, is disposed in the shell 95 between the projectile 109 and the percussion cap 107. Advantageously, the front and rear surfaces 120 and 121, respectively, of the shell 95 may be curved or arched.

One form of improved projectile 109 suitable for use in the cartridge 95 of FIG. 17 is shown in FIG. 18. The projectile includes a relatively soft front tip portion 115 and a relatively hard core portion 116, and has a rifled outer surface 118, which may be knurled in the manner shown in FIG. 19. The projectile 109 is also provided with a rear seal 119.

The purpose of the rifled outer surface is to provide to the projectile a pre-twist defined by the angle $\alpha$, corresponding to the angle of twist of the projectile in flight, such angle typically being in the range of 4°–7°.

The arrangement of FIG. 20 is similar to that of FIG. 18, except that the rifled outer surface of the core portion 116 is of polygonaL cross-section, as shown best in FIG. 21. The polygonal cross-section effects the same type of pre-twist as the knurled cross-section of FIG. 18.

A fin-stabilized form of projectile is shown in FIG. 22.

Such projectile has a spindle body 112 which is coupled to a fin-type stabilizing surface 113, which is illustratively made of aluminum and which may have the cross-section indicated in FIG. 23. Like the projectiles of FIGS. 18 and 20, the projectile of FIG. 22 may be provided with a rear seal 114.

In the foregoing, various arrangements and aspects of the invention have been described. Many variations and modifications will now occur to those skilled in the art. It is accordingly desired that the scope of the appended claims not be limited to the specific disclosure herein contained.

What is claimed is:

1. In a firearm having a trigger mechanism including an actuating lever and an operating rod disposed above the trigger mechanism and longitudinally reciprocable between forward and rear positions, the operating rod having associated in spaced relation thereto a piston and a cartridge chamber, the improvement wherein the trigger mechanism further comprises, in combination, a first lever movable into at least first and second positions indicative of non-continuous and continuous operation of the firearm, respectively, a portion of the first lever having disposed thereon a first indexing means, a second lever normally positionable in the path of the operating rod for restraining the oerating rod, the second lever being engageable with the first lever when the actuating lever is pulled for moving away from said path, advancing means carried by the second lever, the advancing means including second indexing means engageable with the first indexing means on the first lever when the first lever is in its first position, the advancing means further having third indexing means associated therewith, and transport means coupled to the operating rod and having fourth indexing means engageable with the third indexing means on the advancing means for selectively indexing the second lever away from the first lever.

2. A firearm as defined in claim 1, in which the first lever is longitudinally adjustable with respect to the barrel for respectively selecting the first and second positions.

3. A firearm as defined in claim 1, in which a front portion of the operating rod has a first projection, in which the firearm further comprises damping means engageable with the first projection for retarding the forward motion of the operating rod when the first lever is in its second postion, and means disposed on a front portion of the first lever for moving the damping means out of engagement with the first projection when the first lever is in the first position.

4. A firearm as defined in claim 3, in which the damping means comprises, in combination, a cylinder, a piston supported in the cylinder and extendable rearwardly therefrom, a wedge having a surface cooperable with the first projection, a rod extending between the piston and the wedge, and means disposed in the cylinder for retarding the return movement of the piston in the forward direction.

5. A firearm as defined in claim 1, in which the first indexing means comprises a plurality of successive first notches on the rear portion of the first lever, and wherein the second indexing means comprises a first pawl disposed on the advancing means and engageable with the first notches of the first lever.

6. A firearm as defined in claim 5, in which the rear portion of the first lever exhibits an idle notch disposed forwardly of the first notches, the first pawl being engageable with the idle notch when the first lever is in the second position.

7. A firearm as defined in claim 1, further comprising means for normally urging the second lever toward the operating rod.

8. A firearm as defined in claim 1, in which the advancing means comprises, in combination, a cylinder in engagement with the second lever, a piston disposed in the cylinder, and a piston rod extending from the piston and exhibiting the second and third indexing means.

9. A firearm as defined in claim 1, in which the transport means comprises a plate member slidably supported on the second lever.

10. A firearm as defined in claim 1, in which the first indexing means comprises a first pawl disposed on the rear portion of the first lever, and in which the second indexing means comprises a plurality of first notches successively disposed on the advancing means and engageable by the first pawl.

11. A firearm as defined in claim 10, further comprising a third lever supported for oscillation on the second lever, a first portion of the third lever being engageable with the transport means and a second portion of the third lever being engageable with the operating rod.

12. A firearm as defined in claim 1, further comprising means coupled to the first lever for moving the first lever between the first and second positions.

13. A firearm as defined in claim 1, in which the operating rod exhibits a first inclined surface on a rear portion thereof, and in which the firearm further comprises damping means operative when the first lever is in the second position for contacting the first surface of the operating rod to retard the reverse movement of the operating rod.

14. A firearm as defined in claim 1, in which the piston is supported by the operating rod above the trigger mechanism, in which the cartridge chamber is coupled to a rear portion of the operating rod, and in which a tension spring is arranged on the operating rod between the piston and the cartridge chamber.

15. A firearm as defined in claim 1, further comprising means for serially introducing cartridges into the cartridge chamber.

16. A firearm as defined in claim 15, in which the introducing means comprises a shell follower for guiding successive shells into the cartridge chamber, and means coupled to the follower for propelling the guided shell into the cartridge chamber.

17. A firearm as defined in claim 15, in which the introducing means comprises a magazine having a loading chamber, and means for longitudinally dividing the loading chamber into two cartridge compartments, the dividing means including a wall section supported for oscillation between the two compartments.

18. A firearm as defined in claim 1, further comprising a firing pin adapted to impact cartridges introduced into the cartridge chamber, and means for actuating the firing pin during reciprocation of the operating rod.

19. A firearm as defined in claim 18, in which the firing pin actuating means comprises, in combination, a spring fixed to the cartridge chamber, a third lever disposed at a fixed position in the barrel and movable upon movement of the operating rod, and means for coupling the opposite ends of the firing pin to the spring and to the third lever, respectively.

20. A firearm as defined in claim 18, in which the firing pin operating means comprises, in combination, a cylinder, a rotatable disc, a piston coupled to the operating rod for reciprocal movement therewith, a connecting rod coupled between the piston and the disc to impart circular motion to the disc as the piston reciprocates, a first actuating rod, means for connecting one end of the first actuating rod to the firing pin, and means for eccentrically connecting the other end of the first actuating rod to the disc.

21. A firearm as defined in claim 20, further comprising a second actuating rod, means for connecting one end of the second actuating rod to the cartridge chamber, and means for connecting the other end of the actuating rod to the disc, whereby the rotation of the disc is effective to impart oscillation to the cartridge chamber.

22. A firearm as defined in claim 1, further comprising means including at least one toggle lever coupled between the operating rod and the cartridge chamber for oscillating the chamber through discrete positions while the operating rod is reciprocated.

23. A firearm as defined in claim 22, in which the operating rod has a longitudinal slot whose respective ends define the extremes of oscillation of the cartridge chamber, and in which the toggle lever has a projection extending into the longitudinal slot.

24. A firearm as defined in claim 14, in which the firearm further comprises a cylindrical barrel around which the piston is disposed and through which a projectile disposed in the cartridge chamber is discharged, the barrel having a gas-permeable radial slot extending therethrough at a location forwardly of the front end of the piston.

* * * * *